US008807194B2

(12) United States Patent
Shun et al.

(10) Patent No.: US 8,807,194 B2
(45) Date of Patent: Aug. 19, 2014

(54) VENETIAN BLIND

(75) Inventors: Katsumata Shun, Tokyo (JP); Daizen Masaaki, Tokyo (JP); Takagi Koji, Tokyo (JP)

(73) Assignee: Nichibei Co., Ltd., Chuo-Ku, Tokyo (JP)

( * ) Notice: Subject to any disclaimer, the term of this patent is extended or adjusted under 35 U.S.C. 154(b) by 18 days.

(21) Appl. No.: 13/695,962

(22) PCT Filed: May 6, 2011

(86) PCT No.: PCT/JP2011/060586
§ 371 (c)(1),
(2), (4) Date: Nov. 30, 2012

(87) PCT Pub. No.: WO2011/138960
PCT Pub. Date: Nov. 10, 2011

(65) Prior Publication Data

US 2013/0068402 A1 Mar. 21, 2013

(30) Foreign Application Priority Data

May 7, 2010 (JP) ..... 2010-106926
May 27, 2010 (JP) ..... 2010-121995

(51) Int. Cl.
*E06B 9/30* (2006.01)

(52) U.S. Cl.
USPC ..... 160/170

(58) Field of Classification Search
USPC ..... 160/168.1 R, 170, 171, 84.04, 84.05
See application file for complete search history.

(56) References Cited

U.S. PATENT DOCUMENTS

| | | | | | |
|---|---|---|---|---|---|
| 2,572,224 | A | * | 10/1951 | Walker | 160/173 R |
| 2,573,700 | A | * | 11/1951 | Ferguson et al. | 160/173 R |
| 2,578,749 | A | * | 12/1951 | Schultz | 160/168.1 R |
| 2,583,031 | A | * | 1/1952 | Walker | 160/168.1 R |
| 2,786,520 | A | * | 3/1957 | Belfor | 160/168.1 R |
| 5,060,709 | A | * | 10/1991 | Simon | 160/168.1 R |
| 5,386,867 | A | * | 2/1995 | Chen | 160/168.1 R |
| 5,582,226 | A | * | 12/1996 | Voss et al. | 160/168.1 R |
| 5,628,356 | A | * | 5/1997 | Marocco | 160/170 |
| 5,657,806 | A | * | 8/1997 | Hung | 160/168.1 R |
| 6,105,655 | A | | 8/2000 | Judkins | |

(Continued)

FOREIGN PATENT DOCUMENTS

| | | | |
|---|---|---|---|
| JP | 62-182398 | U | 11/1987 |
| JP | 3-87794 | U | 9/1991 |
| JP | 2005-83051 | A | 3/2005 |
| JP | 2006-283321 | A | 10/2006 |
| WO | 2004/088085 | A1 | 10/2004 |

*Primary Examiner* — David Purol

(74) *Attorney, Agent, or Firm* — Miller, Matthias & Hull LLP

(57) ABSTRACT

To reduce an opening and closing operation load in a venetian blind in which a lifting/lowering cord is disposed at a position offset from a central portion in a back and forth direction of a slat. At least one lifting/lowering cord is disposed along one vertical cord of front and back vertical cords and introduced into a head box from one side in a back and forth direction of the head box, and the other lifting/lowering cord is disposed along the other vertical cord and introduced into the head box from the other side in the back and forth direction of the head box. All the lifting/lowering cords introduced into the head box from the different sides in the back and forth direction of the head box are wound in the same direction by the lifting/lowering drums to which the respective ends of the lifting/lowering cords are connected.

8 Claims, 18 Drawing Sheets

(56) References Cited

U.S. PATENT DOCUMENTS

| | | | | |
|---|---|---|---|---|
| 6,116,323 | A * | 9/2000 | Huang | 160/170 |
| 6,179,035 | B1 * | 1/2001 | Anderson | 160/168.1 R |
| 6,192,963 | B1 * | 2/2001 | Chen | 160/168.1 R |
| 6,263,944 | B1 * | 7/2001 | Judkins | 160/168.1 R |
| 6,394,170 | B1 * | 5/2002 | Hsu | 160/168.1 R |
| 7,096,918 | B2 * | 8/2006 | Lin | 160/171 |
| 7,287,569 | B2 * | 10/2007 | Lin | 160/170 |
| 7,540,315 | B2 * | 6/2009 | Chen | 160/171 |
| 2002/0174961 | A1 | 11/2002 | Anderson | |

* cited by examiner

VENETIAN BLIND

CROSS-REFERENCE TO RELATED APPLICATIONS

This application is a 35 USC §371 U.S. national stage filing of International Patent Application No. PCT/JP2011/060586 filed on May 6, 2011, which claims priority under the Paris Convention and 35 USC §119 to Japanese Patent Application No. 2010-106926, filed on May 7, 2010 and Japanese Patent Application No. 2010-121995 filed on May 27, 2010.

FIELD OF THE DISCLOSURE

The present invention relates to a venetian blind in which a lifting/lowering cord is disposed at a position offset from a central portion in a back and forth direction of a slat.

BACKGROUND OF THE DISCLOSURE

In typical venetian blinds having a number of slats held in an aligned state, lifting/lowering cords for lifting and lowering the slats extend penetrating a lifting/lowering cord insertion hole formed in a central portion in a back and forth (transverse) direction of each slat, and an end of the lifting/lowering cord passing through each slat is connected to a bottom rail provided below the slats. The bottom rail is lifted and lowered by the lifting/lowering cords to lift and lower the slats.

Meanwhile, as a venetian blind in which the lifting/lowering cords are disposed at a position offset from the central portion in the back and forth direction of each slat, there have been known the venetian blinds disclosed in Patent Literatures 1 and 2.

In the venetian blind disclosed in the Patent Literature 1, each slat has side edge cut-out portions on both side, with which vertical cords on both side of a ladder cord are adapted to be engaged. By virtue of the engagement between the vertical cords on both-side and the cut-out portions, the slats are positioned in a back and forth direction, and lateral deviation of the slats in the slat longitudinal direction is prevented. At least one lifting/lowering cord is located on one side of the venetian blind in the back and forth direction thereof, and the other lifting/lowering cord is located on the other side of the venetian blind in the back and forth direction thereof. Those lifting/lowering cords are disposed along the vertical cords of the ladder cord to be inserted through loops extended from the vertical cords, and, thus, to connect their one ends to the bottom rail. The other end of the lifting/lowering cords are led in a head box to an end portion of the head box in the longitudinal direction by a guide roller or the like and led out of the head box through a stopper device. When the lifting/lowering cords led out of the head box are lowered, the bottom rail is lifted, and the slats are piled up in sequence from the bottom by the bottom rail. Meanwhile, when the stopper device is released by operating the lifting/lowering cords, the bottom rail and the slats are lowered by their own weights.

As described above, in the venetian blind disclosed in the Patent Literature 1, the lifting/lowering cords are located at the side edge portions of the slats, and the slats do not have any hole through which the lifting/lowering cords are inserted, it is therefore possible to prevent light leakage when the blind is in light shielding state, and, at the same time, because the lifting/lowering cords are disposed in a distributed manner in terms of the back and forth direction, it is possible to prevent the bottom rail from tilting.

In the venetian blind disclosed in the Patent Literature 2, a transverse cord portion of a ladder-shaped supporting cord is constituted of two cords which are arranged in parallel with vertically slightly spaced apart, and a substantially U-shaped cut-out portions are provided at both side edges of a slat at a position supported by the ladder-shaped supporting cord. In order to support the slat by the transverse cord portion of the ladder-shaped supporting cord, the vertical relationship between the two cords of the transverse cord portion is reversed upside down so that cord crossing portions at which the two cords vertically crosses are formed at the both ends of the transverse cord portion. The crossing portions are engaged with the U-shaped cut-out portions of the slat, and the lifting/lowering cord for lifting and lowering the slats is provided along a vertical cord portion of the ladder-shaped support cord on one of outer sides of the slat.

According to the above constitution, in the slats having no hole through which the lifting/lowering cord is inserted, the slats are held between the vertically crossing cords of the transverse cords, and the crossing portions of the transverse cords are engaged with the U-shaped cut-out portions formed at the both side edges of the slat; therefore, the movement of the slats in the horizontal direction can be restricted.

SUMMARY OF THE DISCLOSURE

However, in the venetian blind disclosed in the Patent Literature 1, the other end of the lifting/lowering cord out of the head box is directly operated to perform lifting and lowering operation of the slats, and therefore, in order to raise the slats, the operation of drawing down the other end of the lifting/lowering cord is required to be continued until the slats are piled up at a desired position, and a problem is that it is difficult to apply this constitution to a blind with large product size and weight.

In the venetian blind disclosed in the Patent Literature 2, the engagement between the cut-out portion of the slat and the transverse cord may be accidentally released, and a problem is that lateral deviation in the horizontal direction of the slats cannot be reliably prevented in this case.

In order to solve the above problem, a first object of the present invention is to provide a venetian blind which has a lifting/lowering cord disposed at a position offset from a central portion in a back and forth direction of a slat and can reduce an operation lode of a lifting/lowering cord for lifting and lowering the slats.

In addition to the first object, a second object of the present invention is to provide a venetian blind which can reliably prevent lateral deviation of the slats.

In order to achieve the above objects, the present invention provides a venetian blind which is provided with a rotation shaft rotatably supported in a head box, a plurality of ladder cords capable of tilting in response to the rotation of the rotation shaft, a number of slats supported in an aligned state by the ladder cords, and a plurality of lifting/lowering cords capable of lifting and lowering the slats, and the lifting/lowering cords are disposed at a position offset from a central portion in a back and forth direction of the slat. This venetian blind is provided with a plurality of lifting/lowering drums capable of rotating in response to the rotation of the rotation shaft, and an end of each of the lifting/lowering cords is windably and unwindably connected to each of the respective lifting/lowering drums. At least one lifting/lowering cord is introduced into the head box from one side in the back and forth direction of the head box, whereas the other lifting/lowering cord is introduced into the head box from the other side in the back and forth direction of the head box so that all the lifting/lowering cords introduced into the head box from the different sides in the back and forth direction of the head box can be wound around the lifting/lowering drums in the same direction of the lifting/lowering drums to which the respective ends of the lifting/lowering cords are connected.

Since the lifting/lowering cords introduced from the different sides in the back and forth direction of the head box can be wound around and unwound from the lifting/lowering drums, when the rotation shaft for rotating and driving the lifting/lowering drum is rotated manually, the operation load is reduced in comparison with operation of directly drawing down the lifting/lowering cord, and therefore, this invention can be applied to a blind with large product size and weight.

Further, the rotation shaft can be also electrically rotated and driven to rotate the lifting/lowering drum. In this case, since the lifting/lowering cord may not be manually wound around and unwound from the lifting/lowering drum, the operation is facilitated, and this invention can be applied to a blind attached at a hard to reach position where manual operation is difficult.

Further, since the lifting/lowering cords are introduced from the different sides in the back and forth direction of the head box, the lifting/lowering cord can be arranged at the position offset from the central portion in the back and forth direction of the slat, and the slats can be balanced as a whole at the time of lifting and lowering. Since all the lifting/lowering drums are rotated in the same direction by the common rotation shaft to wind the lifting/lowering cords in the same direction, the structure can be simplified.

Each lifting/lowering drum can be constituted of a drum portion to which an end of each of the lifting/lowering cords is windably and unwindably connected and a drum support supporting the drum portion in a rotatable manner. The drum support can include a lifting/lowering cord guide portion configured to hang the lifting/lowering cord from position offset from the central portion in the back and forth direction of the slat. According to this constitution, the lifting/lowering cord can be reliably hung from the position offset from the central portion in the back and forth direction of the slat.

The drum support can further include ladder cord guide portions which regulate the ladder cord so that an interval in the back and forth direction between front and back vertical cords of the ladder cord is not more than a predetermined amount. The lifting/lowering cord guide portion can be provided outside in the back and forth direction of the ladder cord guide portions. With this constitution, the lifting/lowering cord can be disposed at the position offset from the central portion in the back and forth direction of the slat without applying an excessive force to the ladder cord.

At least one cut-out portion can be formed at a side edge of the slat, and one of the front and back vertical cords of the ladder cord is disposed along at least one cut-out portion. In at least one cut-out portion, the lifting/lowering cord can be disposed so as to be inserted through between the cut-out portion and the vertical cord. With this constitution, the lifting/lowering cord is easily engaged with the cut-out portion, and the deviation in the horizontal direction of the slats can be prevented.

The lifting/lowering cord other than the lifting/lowering cord inserted through between the cut-out portion and the vertical cord can be disposed outside the side edge of the slat along the front and back vertical cords of the ladder cord. Consequently, the slat can be easily inserted at the time of assembling.

The cut-out portion can be formed at only one side edge of the slat so that it opens above the inclined slat when the slats are lifting and opens below the inclined slat when the slats are lowering. With this constitution, there is no possibility of occurrence of such a trouble that the lifting/lowering cord and the ladder cord enter the cut-out portion together when the slats are lifting or lowering and are caught by a corner portion of the cut-out portion, and the slats can be smoothly lifted and lowered.

At least three lifting/lowering drums can be arranged in the longitudinal direction of the head box in such a manner that the right and left outside lifting/lowering drums of the at least three lifting/lowering drums can be connected to the lifting/lowering cord introduced into the head box from one side in the back and forth direction of the head box and turned toward the other side through the lifting/lowering cord guide portion, and at least one inside lifting/lowering drum of the at least three lifting/lowering drums can be connected to the lifting/lowering cord introduced into the head box from the other side in the back and forth direction of the head box and led upward through the lifting/lowering cord guide portion.

Since the lifting/lowering cord connected to the inside lifting/lowering drum is led upward through the lifting/lowering cord guide portion, a load can be less likely to be applied to the lifting/lowering cord connected to the inside lifting/lowering drum. Since the lifting/lowering cord to which a load is less likely to apply is connected to the inside lifting/lowering drum, the load is distributed to the lifting/lowering cords in a balanced manner because in the venetian blind, a pulling force required for lifting and lowering the bottom rail without inclining the bottom rail from the horizontal generally tends to be applied to the inside lifting/lowering drum more strongly than the right and left outside lifting/lowering drums, depending on the end route, i.e. the horizontal distance between the right (or left) edge of the slat and the rightmost (or leftmost) outside lifting/lowering cord. Therefore, durability of the blind as a product can be enhanced.

At least three lifting/lowering drums can be arranged in the longitudinal direction of the head box in such a manner that at least one inside lifting/lowering drum of the at least three lifting/lowering drums can be connected to the lifting/lowering cord which is introduced into the head box from one side in the back and forth direction of the head box and turned toward the other side through the lifting/lowering cord guide portion and the right and left outside lifting/lowering drums of the at least three lifting/lowering drums are connected to the lifting/lowering cord which is introduced into the head box from the other side in the back and forth direction of the head box and led upward through the lifting/lowering cord guide portion.

If the cut-out portion is formed at a side edge of right or left outside of the slat, and when the lifting/lowering cord is inserted through between the cut-out portion and the vertical cord, the slats are inclined so that the cut-out portion faces upward when the slats are lifting, and the slats are inclined so that the cut-out portions face downward when the slats are lowering. Therefore, there is no possibility of occurrence of such a trouble that the lifting/lowering cord and the ladder cord enter the cut-out portion together when the slats are lifting or lowering and are caught by the corner portion of the cut-out portion, and the slats can be smoothly lifted and lowered.

According to the present invention, the operation load applied to the lifting/lowering cord for lifting and lowering the slats can be reduced.

DETAILED DESCRIPTION

Figure 1:
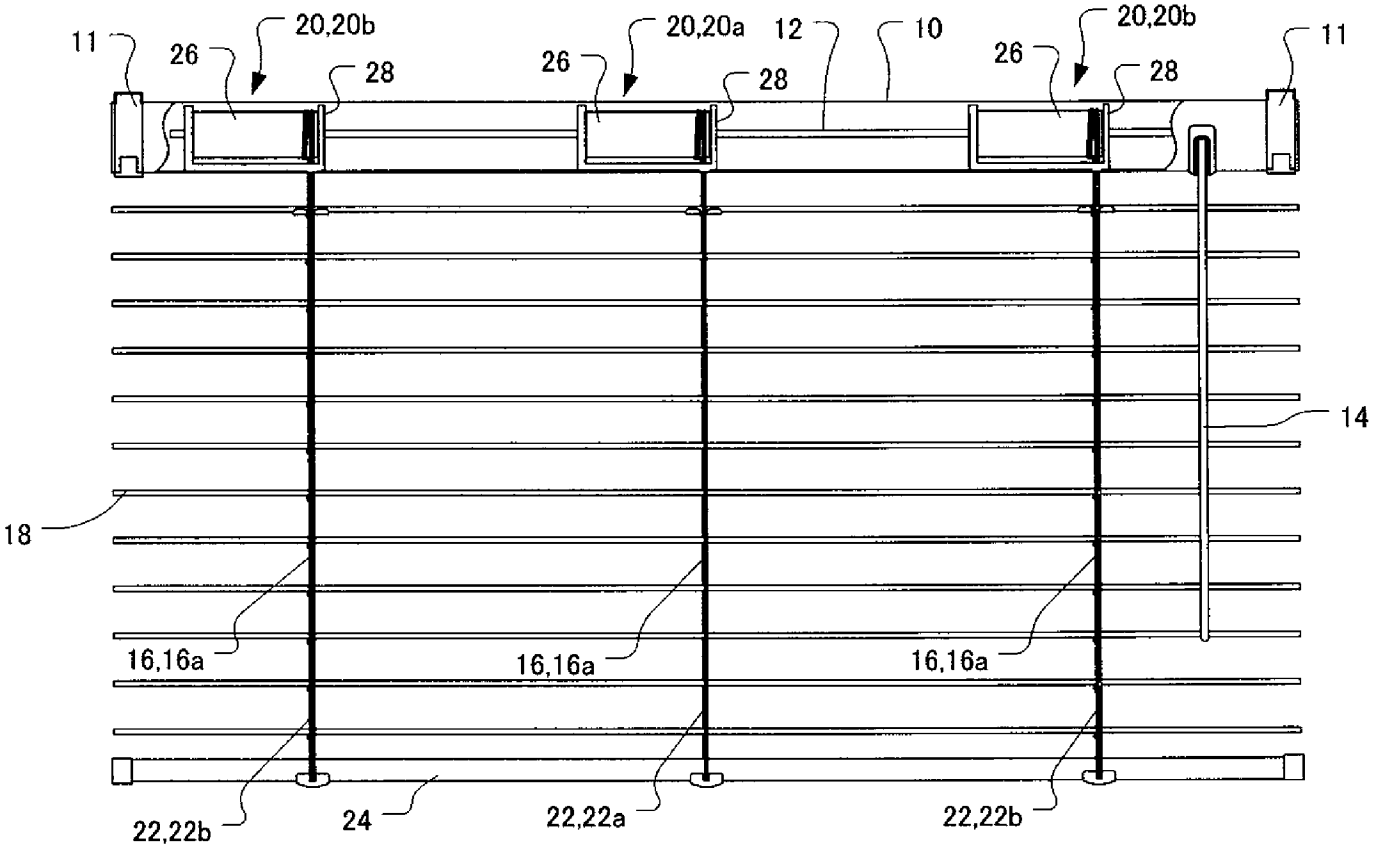
FIG. 1 is a front view showing a slat horizontal/fully open state of a venetian blind according to a first embodiment of the present invention.

Hereinafter, embodiments of the present invention will be described using drawings.

First Embodiment

FIGS. 1 to 10 show a first embodiment of the present invention. The embodiment is particularly suitable for being applied to heavy products.

In a venetian blind of the first embodiment, an endless operating cord (operating portion) 14 is hung from one end of a head box 10 fixed to a window frame or the like by a bracket 11. The operating cord 14 is wound around a pulley (operating portion) 15 disposed in the head box 10 to rotate and drive the pulley 15. The rotation of the pulley 15 can be transmitted to a rotation shaft 12, rotatably supported in the head box 10, through a clutch. The clutch prevents the rotation from the rotation shaft 12, and only the rotation from the pulley 15 is transmitted to the rotation shaft 12. On the rotation shaft 12, three lifting/lowering drums 20 for rotating in response to the rotation of the rotation shaft 12 are provided at a distance in the horizontal direction of the head box 10.

A ladder cord 16 is hung below the head box 10 from the location at which each of the lifting/lowering drums 20 is arranged. Each of the ladder cords 16 can be tilted in response to the rotation of the rotation shaft 12 by a predetermined range angle. Each of the ladder cords 16 is constituted of front and back vertical cords 16*a* and 16*b* each hanging at a predetermined distance in the back and forth (transverse) direction of the head box 10 and transverse cords 16*c* extending between the front and back vertical cords 16*a* and 16*b* at a predetermined interval in the vertical direction. Each of the transverse cords 16*c* is further constituted of a pair of an upper cord and a lower cord slightly vertically separated from each other.

The vertical relationship between the upper cord and the lower cord of each of the transverse cords 16*c* is reversed upside down to form a pair of crossing portions on the way of the transverse cords 16*c*, and a slat 18 is inserted between the crossing portions, whereby a number of the slats 18 are supported in an aligned state by the ladder cord 16. A lower end of the ladder cord 16 is fixed to a bottom rail 24 disposed below the bottom slat 18.

One end of a lifting/lowering cord 22 is windably and unwindably connected to each of the lifting/lowering drums 20. The other end side of the lifting/lowering cord 22 is hung from the head box 10 to pass through a position offset from a central portion in a back and forth direction of the slat so that the end of the lifting/lowering cord 22 is connected to the bottom rail 24.

The lifting/lowering drum 20 is constituted of a drum portion 26 to which one end of the lifting/lowering cord 22 is windably and unwindably connected and a drum support 28 supporting the drum portion 26 in rotatable manner and at the same time fixed to the head box 10. The drum support 28 has ladder cord guide portions 28*a* and 28*b* through which the front and back vertical cords 16*a* and 16*b* of the ladder cord 16 are inserted and which regulates them so that an interval in the back and forth direction between front and back vertical cords 16*a* and 16*b* is not more than a predetermined amount. The drum support 28 further has a first lifting/lowering cord guide portion 28*c* and a second lifting/lowering cord guide portion 28*d* provided more outside than the ladder cord guide portions 28*a* and 28*b* of the drum support 28 in the back and forth direction of the head box 10. The lifting/lowering cord 22 is inserted through the ladder cord guide portions 28*c* and 28*d*, which guide the lifting/lowering cord 22. The lifting/lowering cord 22 can be reliably hung from the position offset from the central portion in the back and forth direction of the slat 18 by virtue of the lifting/lowering cord guide portions 28*c* and 28*d*. The lifting/lowering cord 22 can be arranged at the position offset from the central portion in the back and forth direction of the slat 18 without applying an excessive force to the ladder cord 16 by virtue of the ladder cord guide portions 28*a* and 28*b*. Further, even when the diameter of the lifting/lowering drum 20 is large, an interval between the front and back vertical cords 16*a* and 16*b* of the larder cord 16 is narrowed by the ladder cord guide portions 28*a* and 28*b*, and the rotatability of the slat 18 can be improved.

Hereinafter, the arrangement of the three lifting/lowering drums 20, the arrangement of the three lifting/lowering cords 22, and the connection to each of the lifting/lowering drums 20 will be described.

Figure 3C:
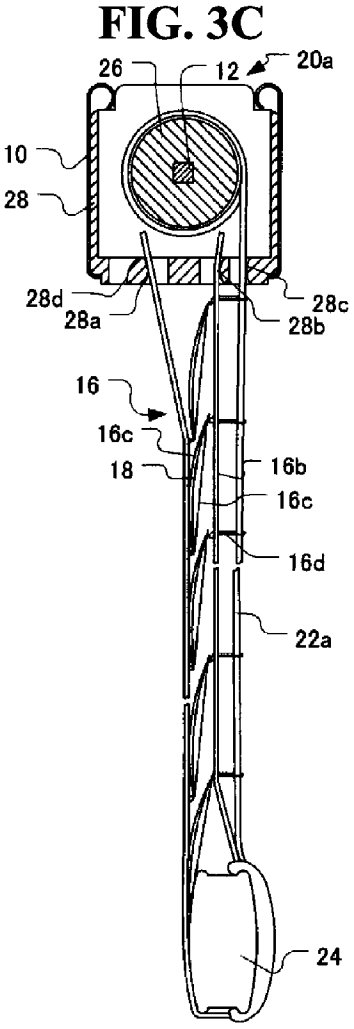
FIG. 3(*a*) is a sectional side view of a first lifting/lowering drum portion in the slat horizontal/fully open state according to the first embodiment, and FIGS. 3(*b*) and 3(*c*) are sectional side views of the first lifting/lowering drum portion in a slat fully closed and lifting/lowering state according to the first embodiment.
Figure 3B:
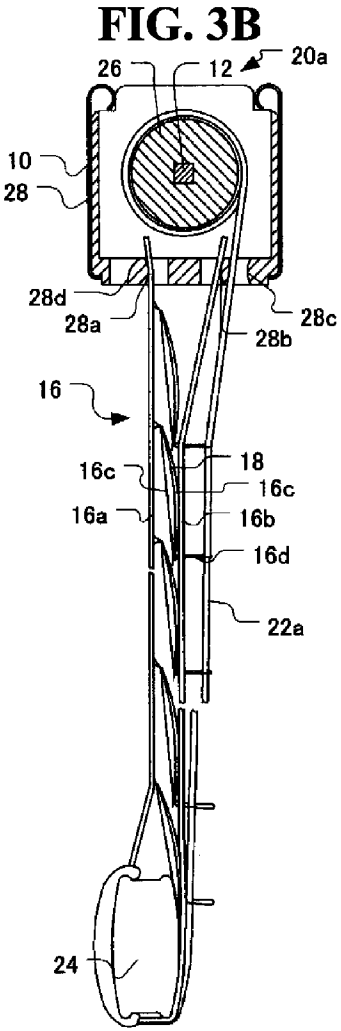
Figure 3A:
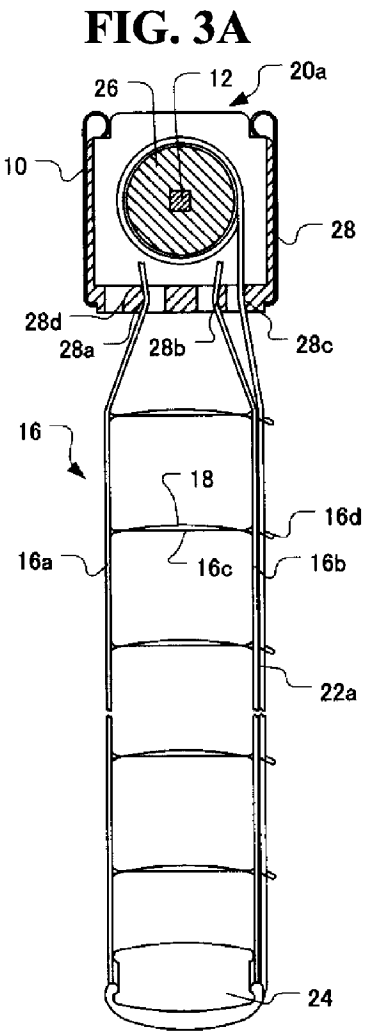
Figure 5:
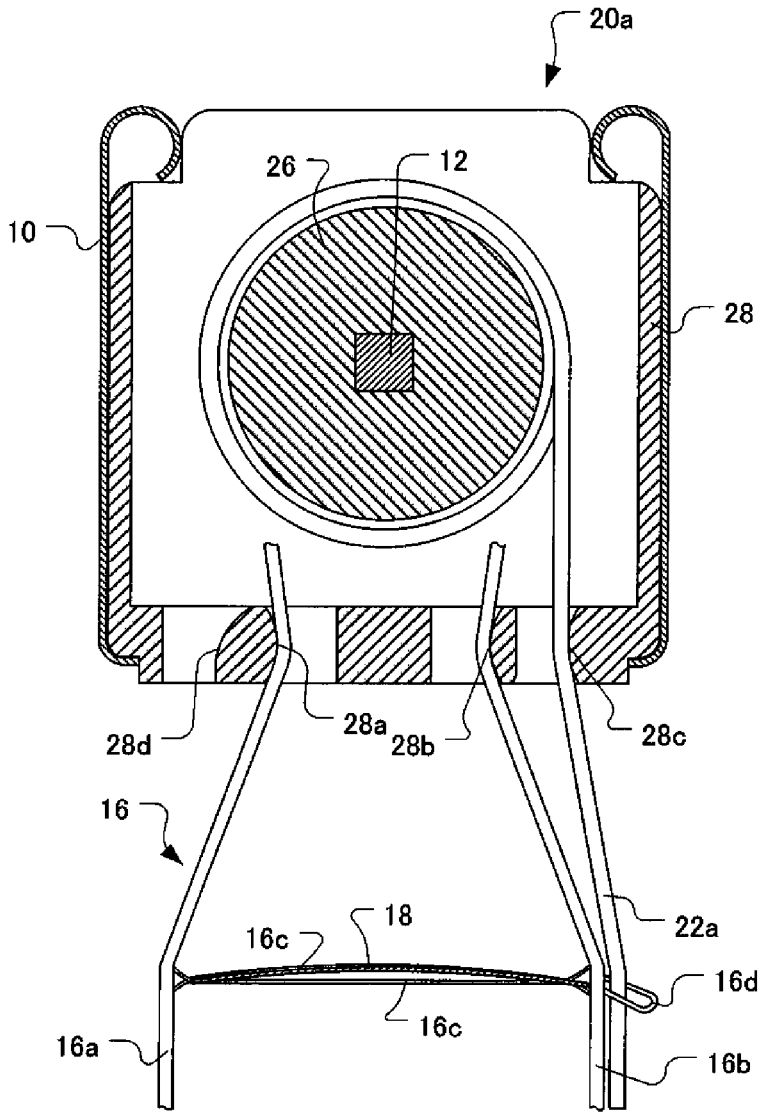
FIG. 5 is a partial sectional side view near a head box showing the first lifting/lowering drum according to the first embodiment.

The disposition of the lifting/lowering cords 22 arranged inside at or near the center in the longitudinal direction of the head box 10 and the connection to the lifting/lowering drum 20 are shown by a first lifting/lowering cord 22*a* and a first lifting/lowering drum 20*a* shown in FIGS. 3 and 5. The first lifting/lowering cord 22*a* is arranged along the back vertical cord 16*b* of the front and back vertical cords 16*a* and 16*b* and inserted through a loop portion 16*d* protruding more backward from a connecting portion with each of the transverse cords 16*c* of the vertical cord 16*b*. One end of the first lifting/lowering cord 22*a* is led upward after passing the back first lifting/lowering cord guide portion 28*c* of the drum support 28 so as to be connected to the drum portion 26 of the first lifting/lowering drum 20*a* and then wound around the drum potion 26 in one direction.

Figure 4C:
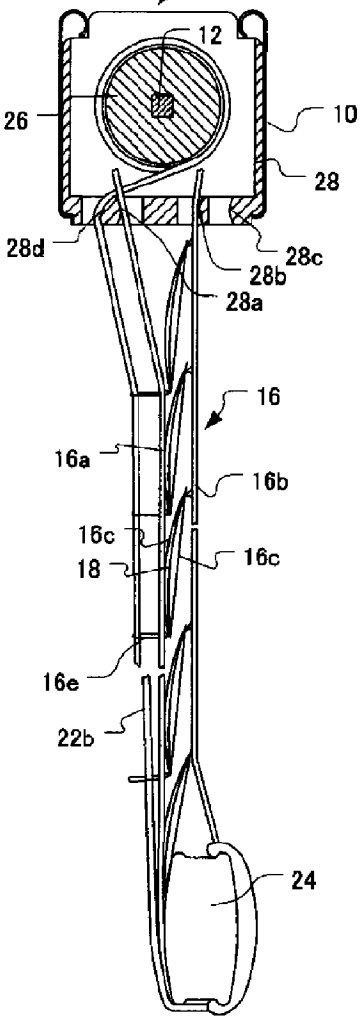
FIG. 4(*a*) is a sectional side view of a second lifting/lowering drum portion in a slat horizontal state according to the first embodiment, and FIGS. 4(*b*) and 4(*c*) are sectional side views of the second lifting/lowering drum portions in the slat fully closed and lifting/lowering state according to the first embodiment.
Figure 4B:
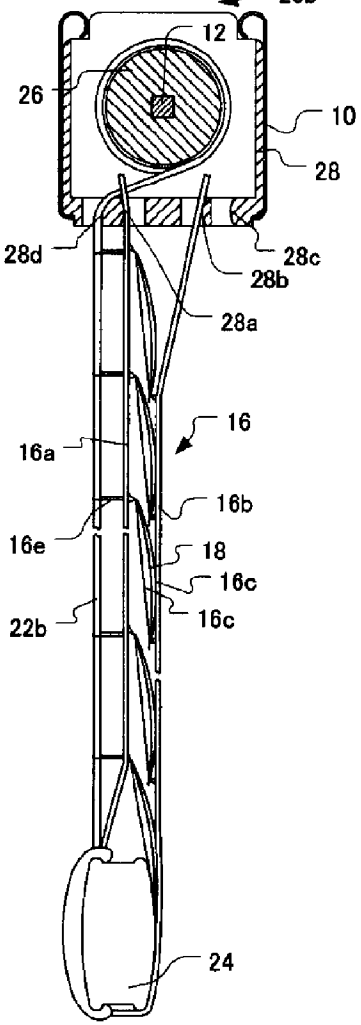
Figure 4A:
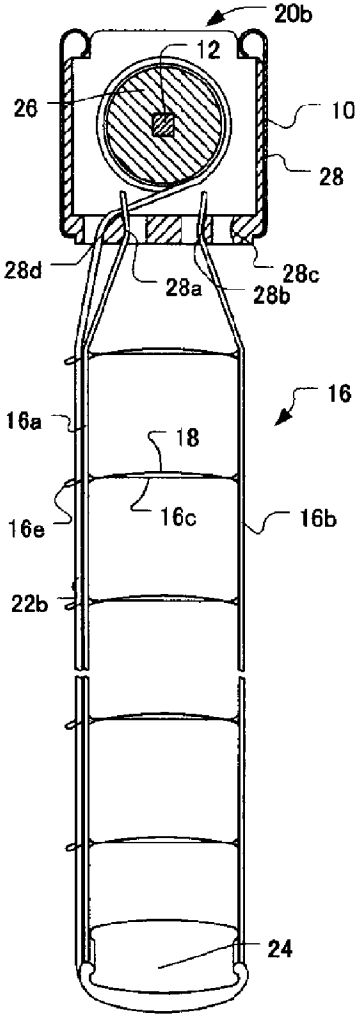
Figure 6:
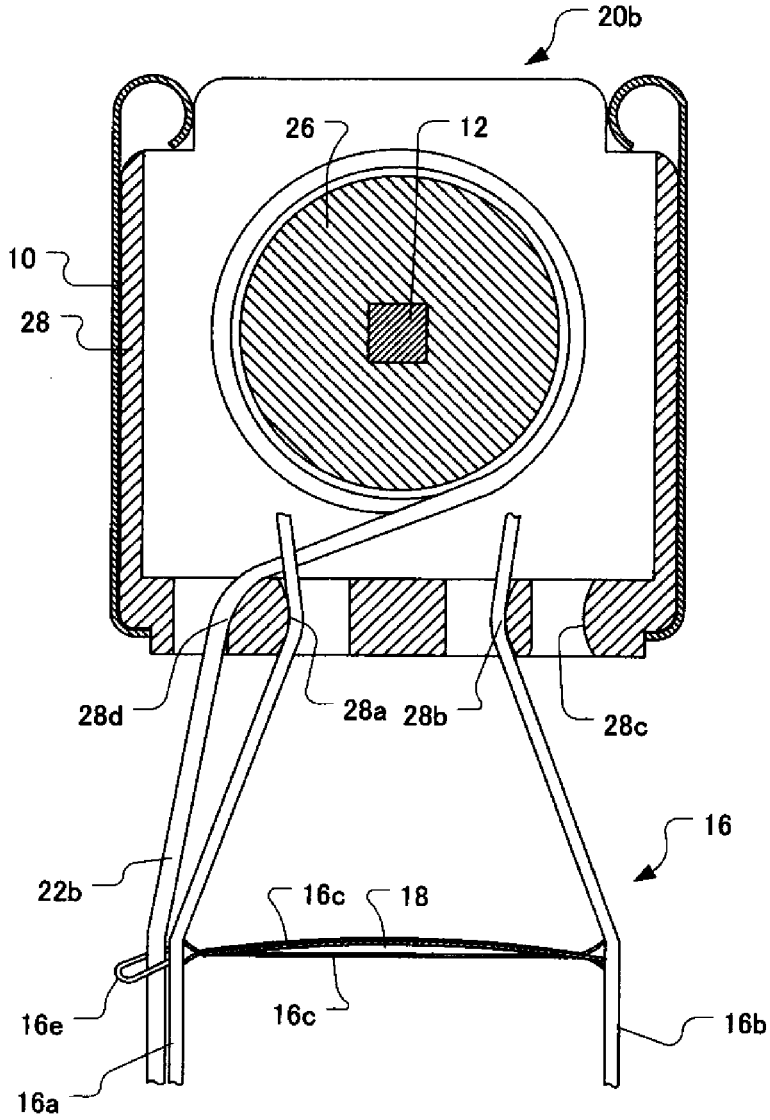
FIG. 6 is a partial sectional side view near the head box showing the second lifting/lowering drum according to the first embodiment.

Meanwhile, the disposition of the lifting/lowering cords 22 arranged outside in the longitudinal direction of the head box 10 and the connection to the lifting/lowering drum 20 are shown by a second lifting/lowering cord 22*b* and a second lifting/lowering drum 20*b* shown in FIGS. 4 and 6. The second lifting/lowering cord 22*b* is arranged along the front vertical cord 16*a* and inserted through a loop portion 16*e* protruding more forward from a connecting portion with each of the transverse cords 16*c* of the vertical cord 16*a*. One end of the second lifting/lowering cord 22*b* is turned backward after passing the front second lifting/lowering cord guide portion 28*d* of the drum support 28 so as to be connected to the drum portion 26 of the second lifting/lowering drum 20*b* and then wound around the drum portion 26 in the same direction as the first lifting/lowering cord 22*a*.

According to the above constitution, the first lifting/lowering cord 22*a* and the second lifting/lowering cord 22*b* are simultaneously wound around or unwound from the first lifting/lowering drum 20*a* and the second lifting/lowering drum 20*b*, respectively, by that the first and second lifting/lowering drums 20*a* and 20*b* rotate in the same direction in response to the rotation of the rotation shaft 12.

Figure 7:
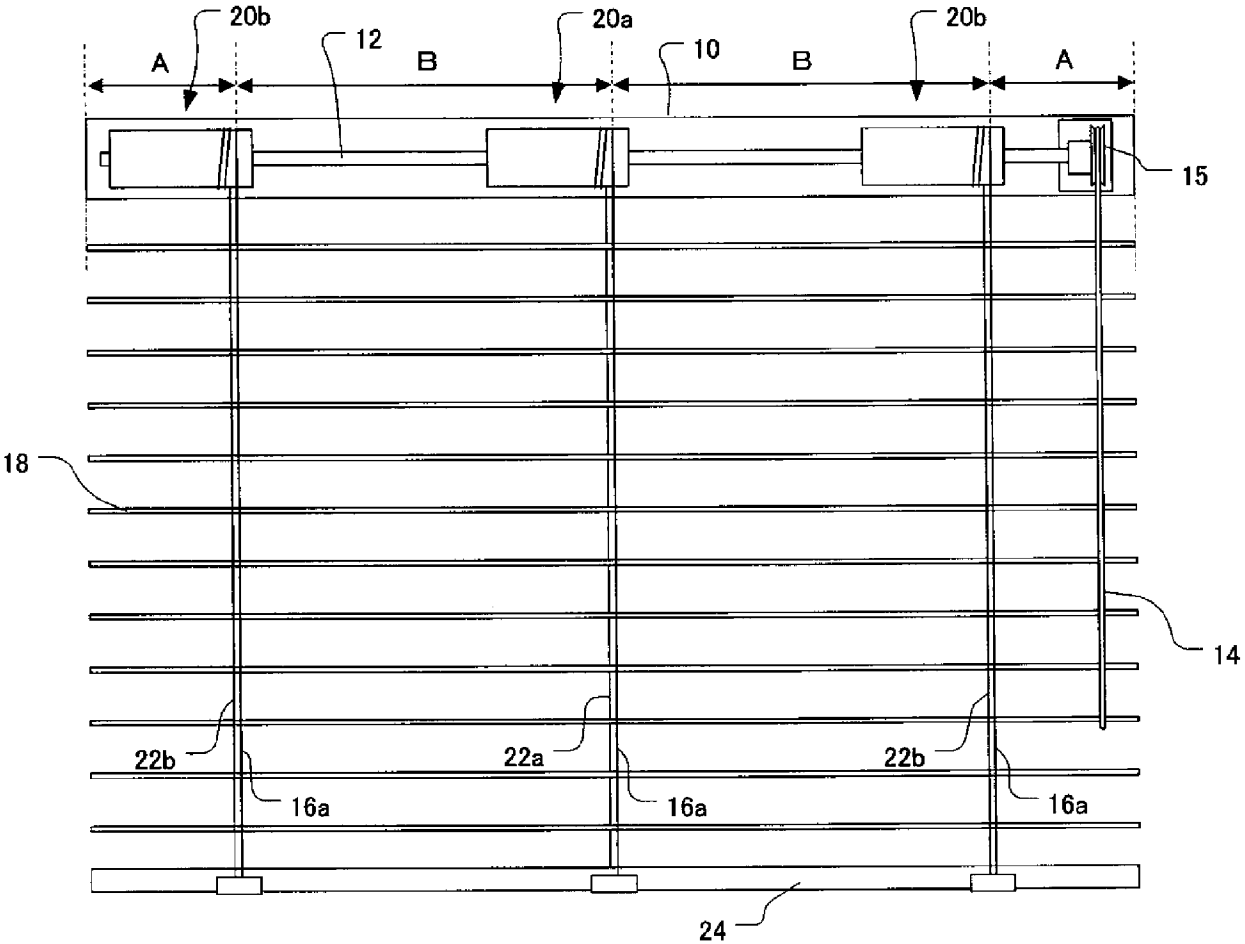
FIG. 7 is a front explanatory view of the venetian blind showing intervals between ladder cords and between lifting/lowering cords.

As shown in FIG. 7, the lifting/lowering drums 20*a* and 20*b* are arranged so that distances B between the first lifting/lowering cord 22*a* located inside at or near the center in the longitudinal direction and the second lifting/lowering cords 22*b* located outside in the longitudinal direction are equal to each other, and distances A (slat projecting size) between each of the second lifting/lowering cords 22*b* and an end of the slat 18 closer to each of the second lifting/lowering cords 22*b* are constant, and the lifting/lowering drums 20*a* and 20*b* are located so that the distance A is smaller than the distance B.

Figure 10:
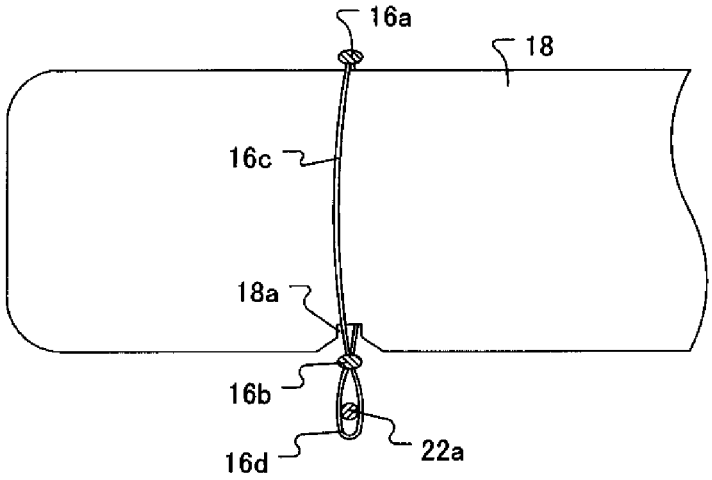
FIG. 10 is a partial plan view showing a state of the lifting/lowering cord, the ladder cord, and the cut-out portion of the first embodiment.

As shown in FIG. 10, at least one cut-out portion 18*a* is formed at the rearward side edge of the slat 18, and the crossing portion of the transverse cord 16*c* of the ladder cord 16 is received by the cut-out portion 18*a*, whereby lateral deviation in the horizontal direction of the slat 18 is prevented.

Now, the operation of the venetian blind of the first embodiment will be described.

Figure 2:
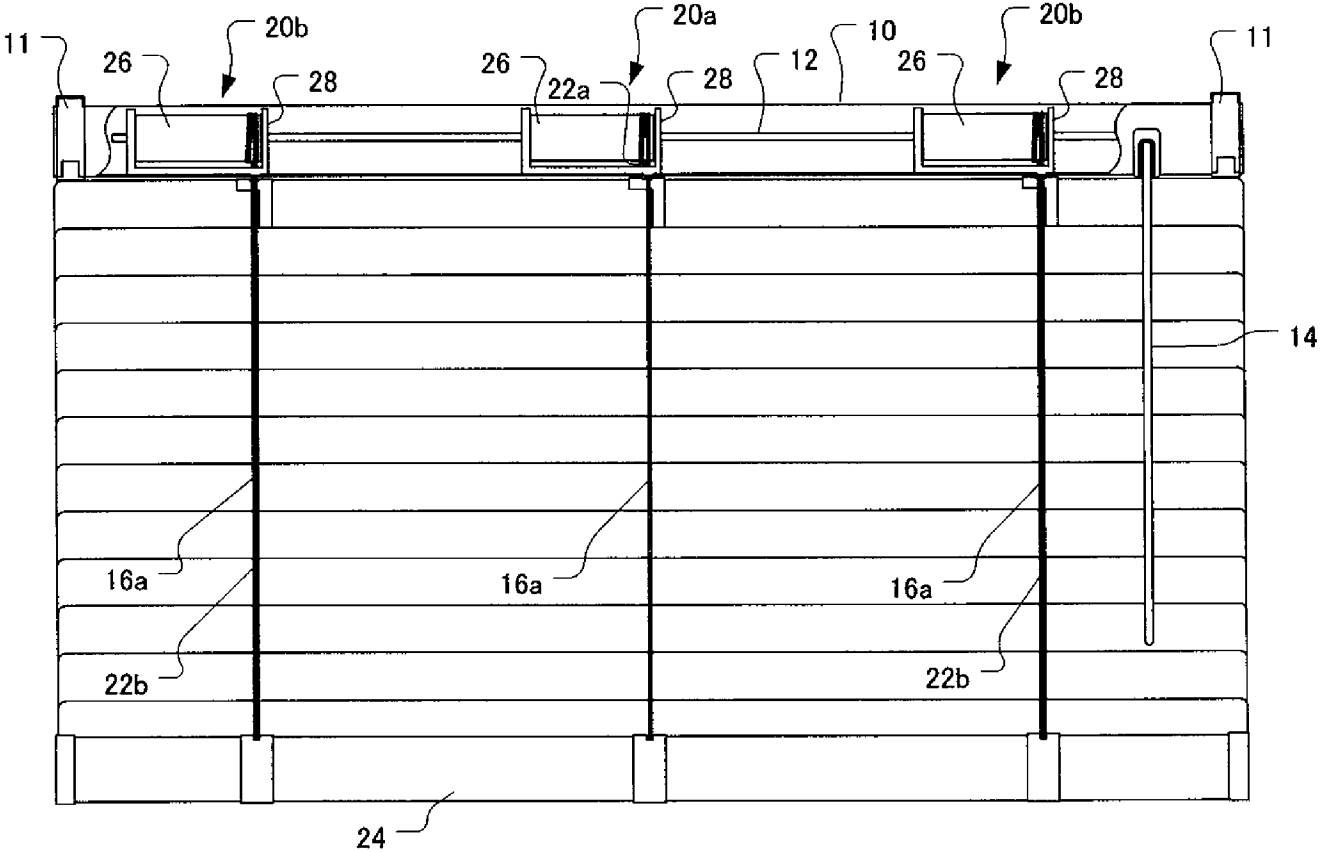
FIG. 2 is a front view showing a slat fully closed state of the venetian blind according to the first embodiment of the present invention.

First, in order to rotate the slats 18 from a horizontal fully open state as shown in FIG. 1 to a fully closed state as shown in FIG. 2, the back side of the operating cord 14 is pulled down to rotate and drive the pulley 15, thus, to rotate the rotation shaft 12 in the clockwise direction in FIGS. 3(*a*) and 4(*a*). Consequently, as shown in FIGS. 3(*b*) and 4(*b*), while the back vertical cord 16*b* is lowered, the front vertical cord 16*a* is lifted, and the ladder cords 16 are tilted to incline each of the slats 18, whereby the slats can be placed in the fully closed state.

Alternatively, in order to rotate the slats 18 from the horizontal fully open state as shown in FIG. 1 to a fully closed state, the front side of the operating cord 14 is pulled down to rotate and drive the pulley 15, and, thus, to rotate the rotation shaft 12 in the counterclockwise direction in FIGS. 3(*a*) and 4(*a*). Consequently, as shown in FIGS. 3(*c*) and 4(*c*), while the back vertical cord 16*b* is lifted, the front vertical cord 16*a* is lowered, and the ladder cords 16 are tilted to incline each of the slats 18, whereby the slats 18 can be placed in the fully closed state.

While the slat is rotating, the first lifting/lowering cord 22*a* is located more backward than the back vertical cord 16*b* as shown in FIGS. 3(*b*) and 3(*c*), and the second lifting/lowering cord 22*b* is located more forward than the front vertical cord 16*a* as shown in FIGS. 4(*b*) and 4(*c*), therefore, the first and second lifting/lowering cords 22*a* and 22*b* do not touch the inclining slats 18 and interfere with the rotation of the slats.

Next, in order to lift the slats 18, the operation of pulling down the front side of the operation cord 14 is first performed. This operation of pulling down the front side of the operation cord 14 is continued after the slats 18 are in the fully closed state and the ladder cord 16 cannot be rotated furthermore, and allows the first lifting/lowering drum 20*a* to wind the first lifting/lowering cord 22*a*, and each of the second lifting/lowering drums 20*b* to wind each of the second lifting/lowering cords 22*b*. Consequently, the first lifting/lowering cord 22*a* is lifted through the first lifting/lowering cord guide portion 28*c*, and each of the second lifting/lowering cords 22*b* is lifted through the second lifting/lowering cord guide portion 28*d*. Thus, the first lifting/lowering cord 22*a* and the second lifting/lowering cord 22*b* can lift the bottom rail 24, as a result the slats are piled up and lifted.

On the other hand, in order to lower the slats 18, the operation of pulling down the back side of the operating cord 14 is first performed. This operation of pulling down the back side of the operating cord 14 is continued after the slats 18 are in the fully closed state and the ladder cord 16 cannot be rotated furthermore, and allows the first lifting/lowering drum 20*a* to unwind the first lifting/lowering cord 22*a*, and each of the second lifting/lowering drums 20*b* to unwind each of the second lifting/lowering cords 22*b*. Consequently, the first lifting/lowering cord 22*a* is lowered through the first lifting/lowering cord guide portion 28*c*, and each of the second lifting/lowering cords 22*b* is lowered through the second lifting/lowering cord guide portion 28*d*. Thus, the first lifting/lowering cord 22*a* and the second lifting/lowering cord 22*b* lower the bottom rail 24, as a result the slats are lowered.

As described above, the operation of the operating cord 14 allows the lifting/lowering cords 22*a* and 22*b* to be wound around or unwound from the lifting/lowering drums 20*a* and 20*b* to lift and lower the slats 18, and therefore the operation load can be reduced.

The lifting/lowering cords 22 can be disposed at the position offset from the central portion in the back and forth direction of the slat 18, and, when the slats 18 are lifted and lowered, the slats 18 and the bottom rail 24 can be balanced as a whole. Since the lifting/lowering cords 22 are disposed along the vertical cords 16*a* and 16*b* of the ladder cord 16, any lifting/lowering cord insertion hole is not required to be provided in the slat 18, and light leakage can be prevented when the slats are fully closed.

Figure 8:
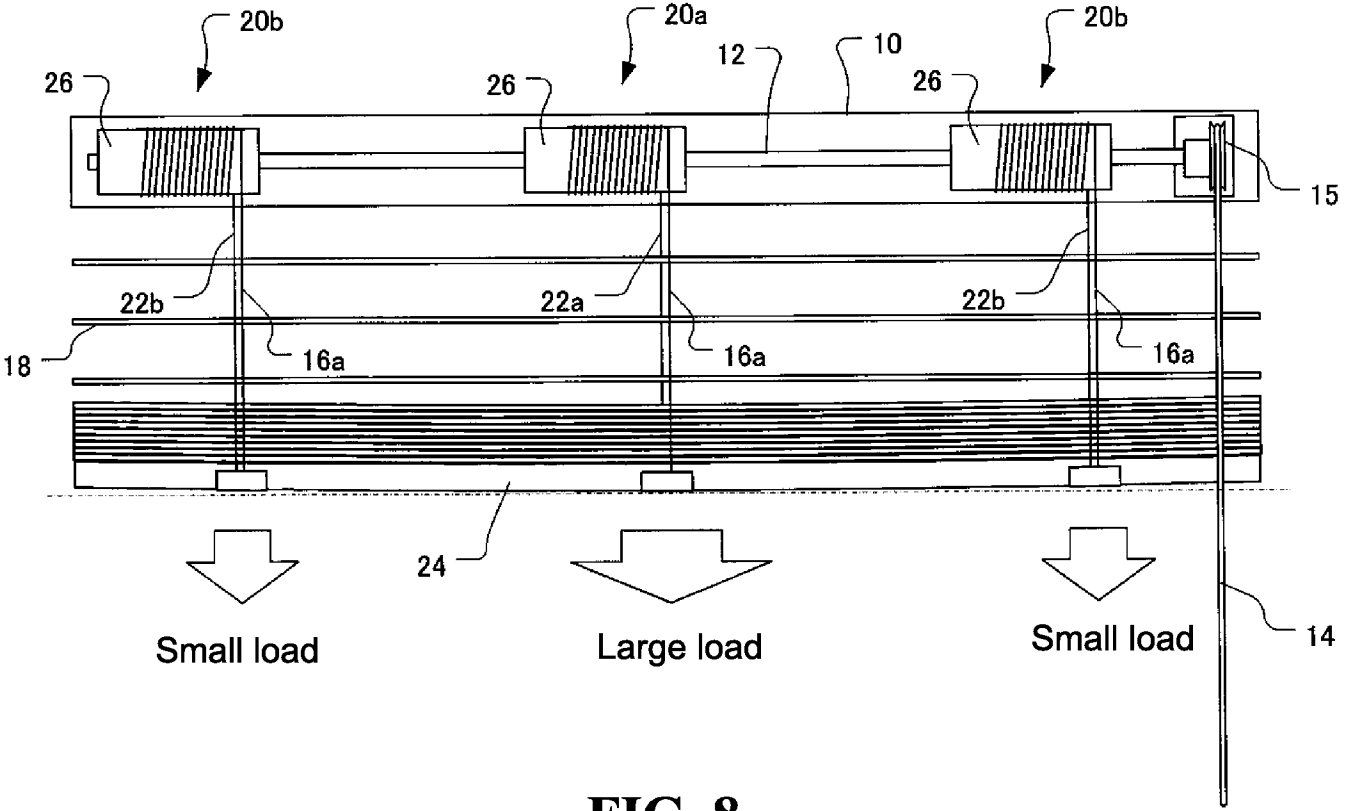
FIG. 8 is a front explanatory view of the venetian blind when a bottom rail is stopped during lifting/lowering, according to the first embodiment.
Figure 9:
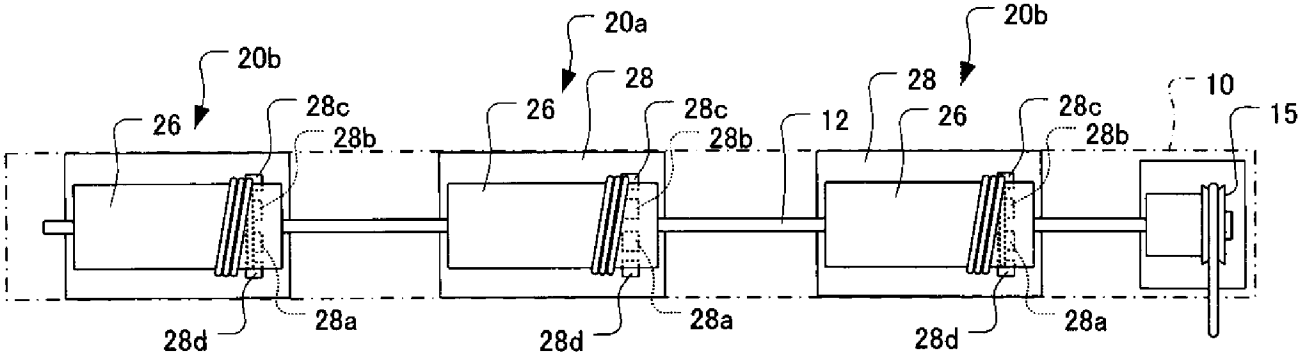
FIG. 9 is a plan view showing an inside of the head box according to the first embodiment.

As shown in FIG. 8, regarding the load applied to each of the lifting/lowering cords 22*a* and 22*b*, the load applied to the first lifting/lowering cord 22*a* wound around the first lifting/lowering drum 20*a* provided inside at or near the center is usually larger than the load applied to the second lifting/lowering cords 22*b* provided outside because the first lifting/lowering cord 22*a* is required to provide a larger pulling force than the second lifting/lowering cords 22*b* for lifting and lowering the horizontal bottom rail 24 without inclining the bottom rail 24 from the horizontal, depending on the end route, i.e. the horizontal distance between the right or left edge of the slat and the rightmost or leftmost outside lifting/lowering cord. On the other hand, the first lifting/lowering cord 22*a* is arranged through a first lifting/lowering cord guide portion 28*c* guiding the first lifting/lowering cord 22*a* upward with less bending of the first lifting/lowering cord 22*a*, whereby resistance applied to the first lifting/lowering cord 22*a* is reduced, and the second lifting/lowering cord 22*b* is bent by turning the direction of the second lifting/lowering cord 22*b* through the second lifting/lowering cord guide 28*d* with more bending resistance, whereby resistance applied to the second lifting/lowering cord 22*b* is increased. Therefore, the load is distributed to each of the lifting/lowering cords 22*a* and 22*b* in a balanced manner, and durability of the blind as a product can be enhanced.

Although the three lifting/lowering drums 20 and the three lifting/lowering cords 22 are provided in the above example, this invention is not limited to this, and two or four or more lifting/lowering drums and lifting/lowering cords may be provided. For example, if two lifting/lowering drums 20 and two lifting/lowering cords 22 are provided, any one of the lifting/lowering cords 22 and any one of the lifting/lowering drums 20 may be used as the first lifting/lowering cord 22*a* and the first lifting/lowering drum 20*a*, and the other of the lifting/lowering cords 22 and the other of the lifting/lowering drums 20 may be used as the second lifting/lowering cord 22*b* and the second lifting/lowering drum 20*b*. If four lifting/lowering drums 20 and four lifting/lowering cords 22 are provided, two lifting/lowering cords 22 and two lifting/lowering drums 20 arranged inside at or near the center in the longitudinal direction of the head box 10 may be used as the first lifting/lowering cords 22*a* and the first lifting/lowering drums 20*a*, and the other two lifting/lowering cords 22 and the other two lifting/lowering drums 20 arranged outside near the ends in the longitudinal direction of the head box 10 may be used as the second lifting/lowering cords 22*b* and the second lifting/lowering drums 20*b*.

Second Embodiment

Now, a second embodiment will be described based on FIGS. 11 to 16. This embodiment is particularly suitable for reliably preventing the deviation in the horizontal direction of the slats 18. Hereinafter, descriptions about constitutions the same as those of the first embodiment will be omitted, and members the same as those of the first embodiment are assigned to the same reference numerals as in the first embodiment.

Figure 11:
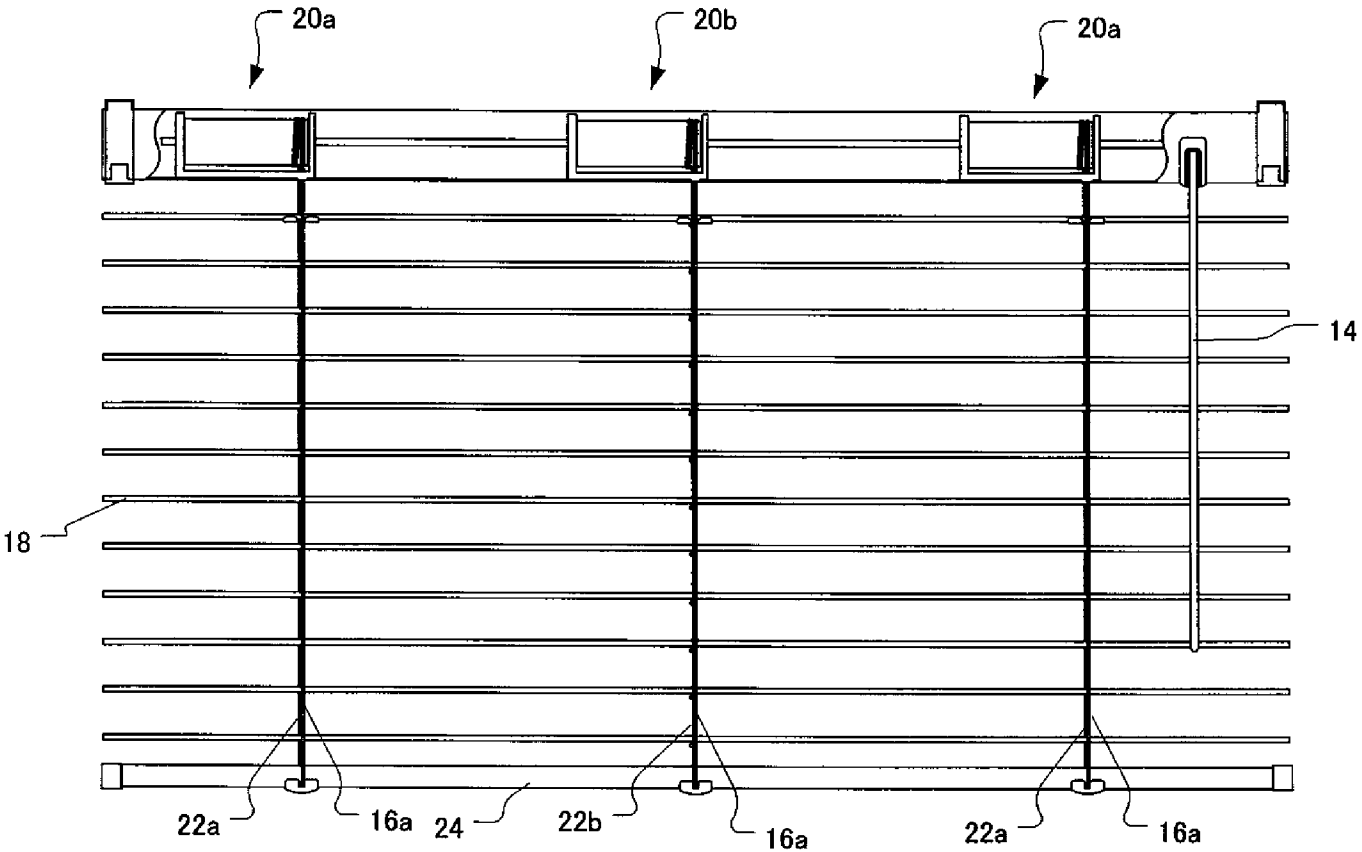
FIG. 11 is a front view showing a slat horizontal/fully open state of a venetian blind according to a second embodiment of the present invention.
Figure 12:
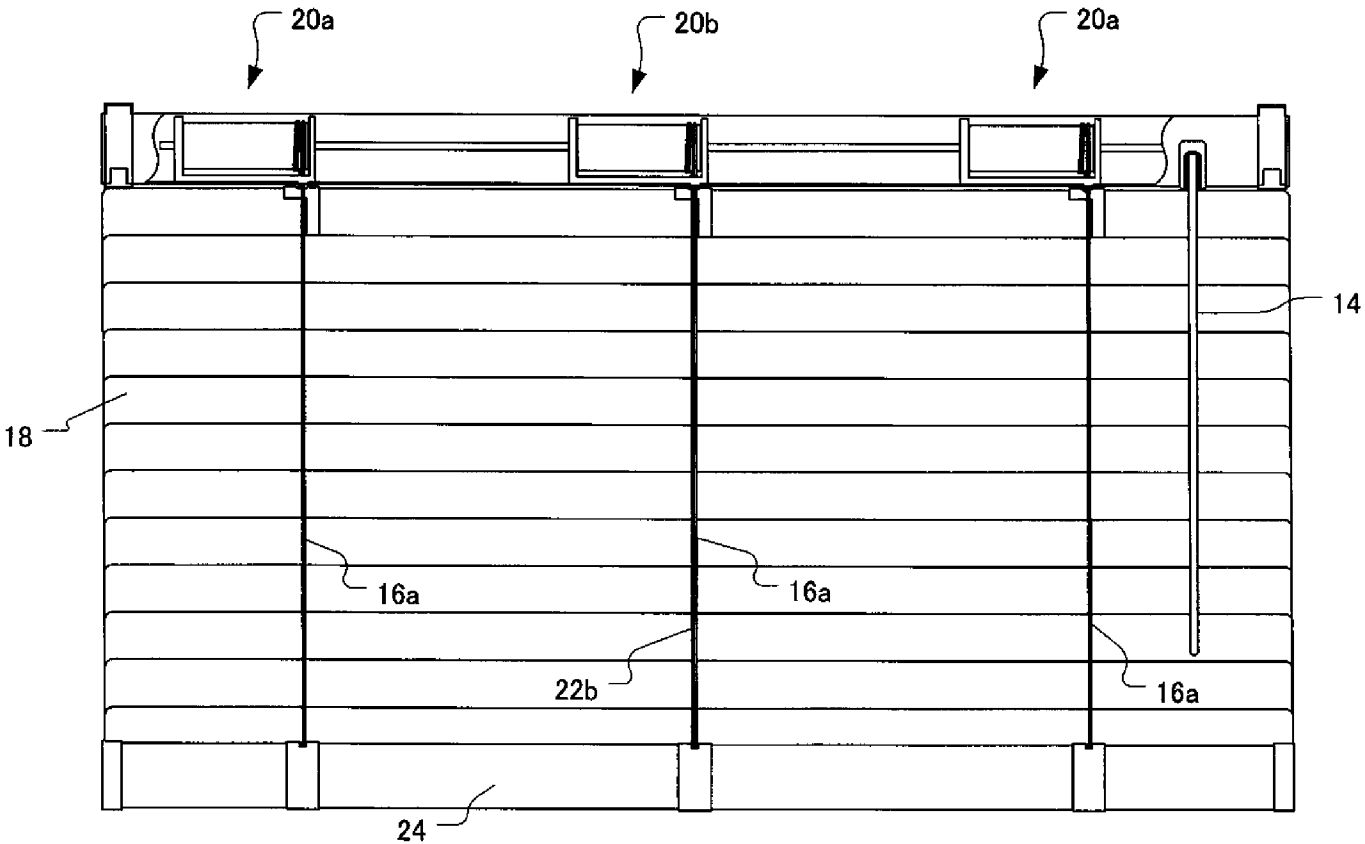
FIG. 12 is a front view showing a slat fully closed state of the venetian blind according to the second embodiment.
Figure 13A:
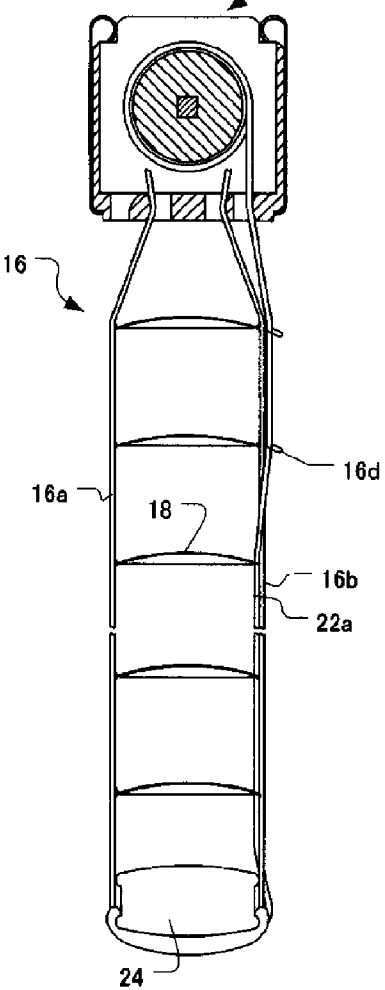
FIG. 13(*a*) is a sectional side view of a first lifting/lowering drum portion in the slat horizontal/fully open state according to the second embodiment, and FIGS. 13(*b*) and 13(*c*) are sectional side views of the first lifting/lowering drum portion in a slat fully closed and lifting/lowering state according to the second embodiment.
Figure 13B:
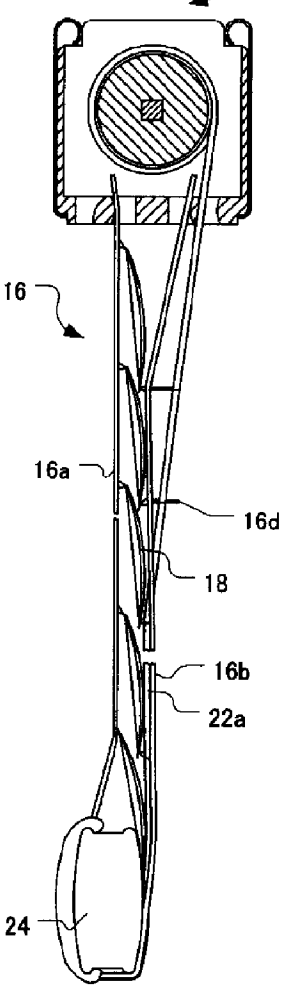
Figure 13C:
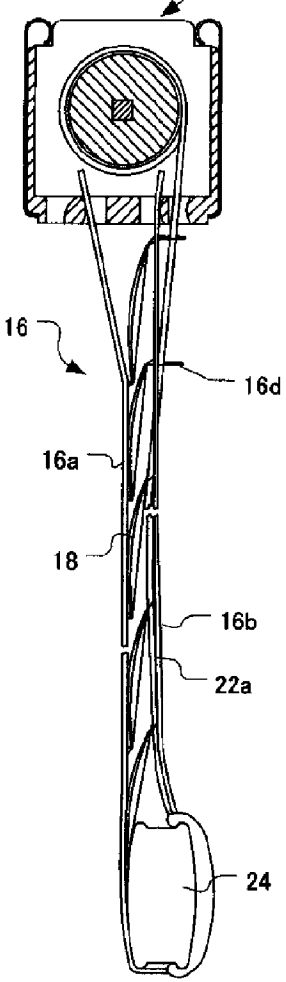
Figure 14C:
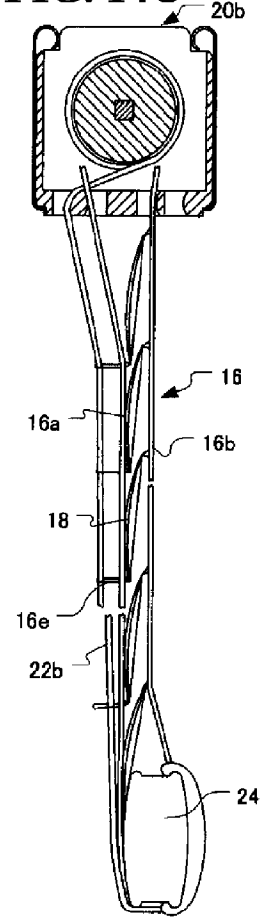
FIG. 14(*a*) is a sectional side view of a second lifting/lowering drum portion in the slat horizontal/fully open state according to the second embodiment, and FIGS. 14(*b*) and 14(*c*) are sectional side views of the second lifting/lowering drum portions in the slat fully closed and lifting/lowering state according to the second embodiment.
Figure 14B:
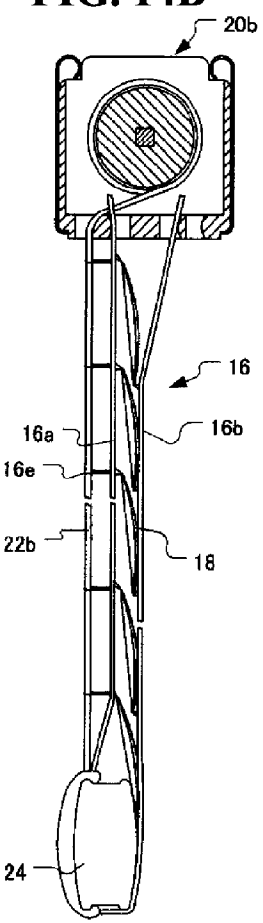
Figure 14A:
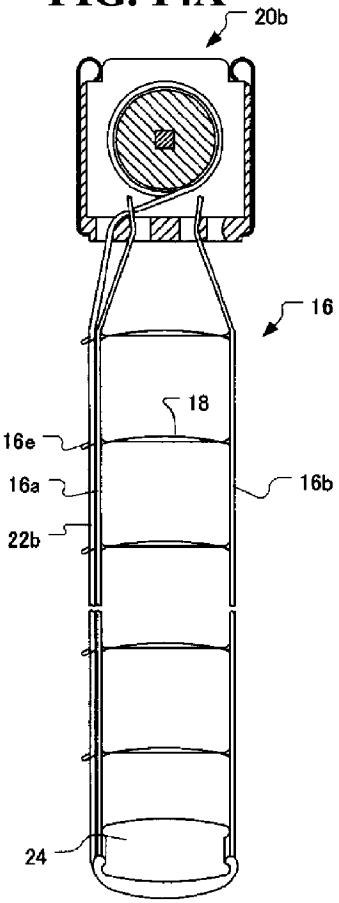

In the second embodiment, the first lifting/lowering drum 20*a*, the first lifting/lowering cord 22*a*, and the back vertical cord 16*b* arranged inside at or near the center in the longitudinal direction of the head box 10 in the first embodiment are arranged outside in the longitudinal direction of the venetian blind as shown in FIG. 13. The second lifting/lowering drum 20*b*, the second lifting/lowering cord 22*b*, and the front vertical cord 16*a* arranged outside in the longitudinal direction in the first embodiment are arranged inside at or near the center in the longitudinal direction of the venetian blind as shown in FIG. 14. Accordingly, as shown in FIGS. 11 and 12, the second lifting/lowering cord 22*b* arranged inside at or near the center in the longitudinal direction is disposed in front of the slats 18, and the first lifting/lowering cord 22*a* arranged outside in the longitudinal direction is disposed behind of the slats 18.

Figure 15:
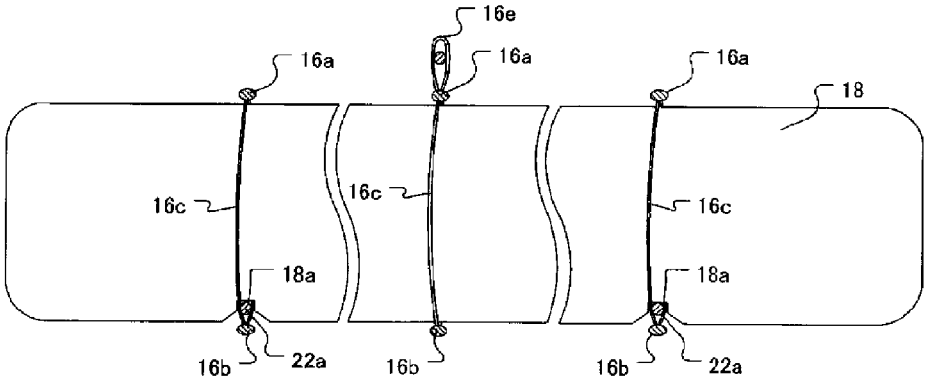
FIG. 15 is a plan view showing a state of a lifting/lowering cord, a ladder cord, and a cut-out portion according to the second embodiment.
Figure 16C:
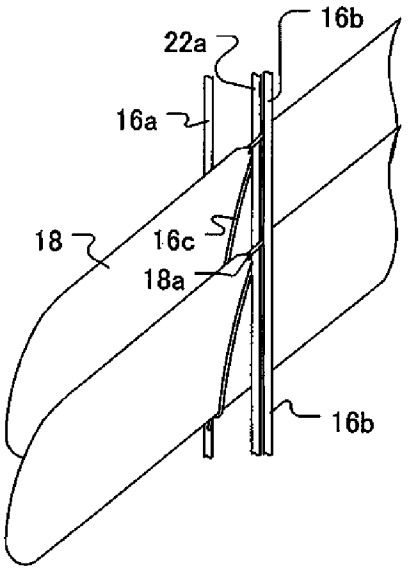
FIG. 16(*a*) is a partial perspective view showing a state near the cut-out portion in a slat horizontal state according to the second embodiment, FIG. 16(*b*) is a partial perspective view showing a state near the cut-out portion when the slats are lowered, according to the second embodiment, and FIG. 16(*c*) is a partial perspective view showing a state near the cut-out portion when the slats are lifted, according to the second embodiment.
Figure 16B:
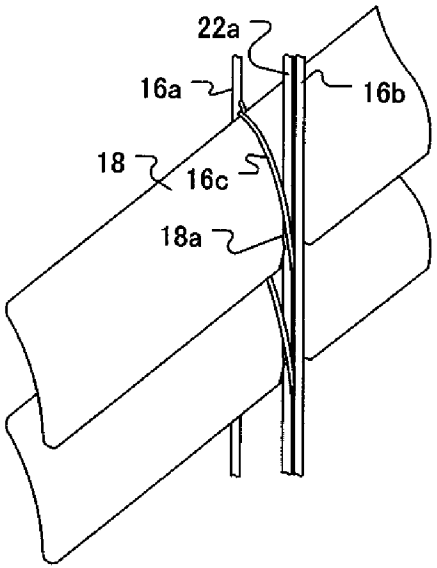
Figure 16A:
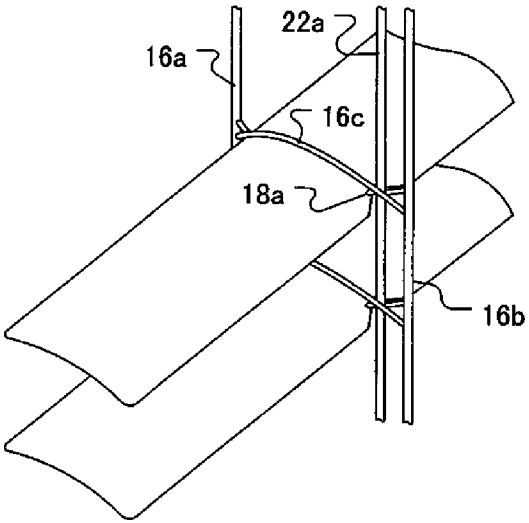

As shown in FIG. 15, one or more cut-out portions 18*a* is provided at the rearward side edge of each of the slats 18, and as shown in FIGS. 13, 15, and 16, a portion of the first lifting/lowering cord 22*a* from an intermediate position in the vertical direction of the vertical cord 16*b* to the lower end is inserted into the cut-out portion 18*a* of one or more slats 18 and disposed to be inserted through between the cut-out portion 18*a* and the vertical cord 16*b*, and the other portion of the first lifting/lowering cord 22*a* from the intermediate position in the vertical direction of the vertical cord 16*b* to the first lifting/lowering drum 20*a* is disposed as in the first embodiment.

As described above, since the first lifting/lowering cord 22*a* is inserted into the cut-out portion 18*a* and inserted through between the cut-out portion 18*a* and the vertical cord 16*b*, the engagements between the cut-out portion 18*a*, and the first lifting/lowering cord 22*a* and the vertical cord 16*b* are further less likely to be released. Thus, since the movement in the horizontal direction of the slat 18 is restricted by the cut-out portion 18*a* and the first lifting/lowering cord 22*a*, the deviation in the horizontal direction of the slat 18 can be further reliably prevented. Further, by the provision of the cut-out portion 18*a*, the rotatability in the rotation of the slat can be improved. When a plurality of the cut-out portions 18*a* are provided in the slat 18 (the cut-out portions 18*a* may be provided at both or one of the forward and rearward edges of the slat), the lifting/lowering cords 22 are not required to be inserted through between the vertical cord and all the cut-out portions, but at least one lifting/lowering cord 22 may be inserted through between the vertical cord and at least one cut-out portion 18*a*. Near the other cut-out portions, the lifting/lowering cord may be inserted through the loop portions.

The slats 18 can be rotated and lifted/lowered as in the first embodiment. When the slats 18 are lifted according to this embodiment, the slats 18 are inclined and lifted so that the cut-out portions 18*a* face upward as shown in FIGS. 13(*c*) and 16(*c*), and therefore, there is no possibility of occurrence of such a trouble that the first lifting/lowering cord 22*a* and the ladder cord 16 enter the cut-out portion 18*a* together or caught by the corner of the cut-out portion 18*a*, and the slats 18 can be smoothly lifted.

When the slats 18 are lowered, the slats 18 are inclined and lowered so that the cut-out portions 18*a* face downward as shown in FIGS. 13(*b*) and 16(*b*), and therefore, there is no possibility of occurrence of such a trouble that the first lifting/lowering cord 22*a* and the ladder cord 16 enter the cut-out portion 18*a* together or caught by the corner of the cut-out portion 18*a*, and the slats 18 can be smoothly lowered.

Figure 18:
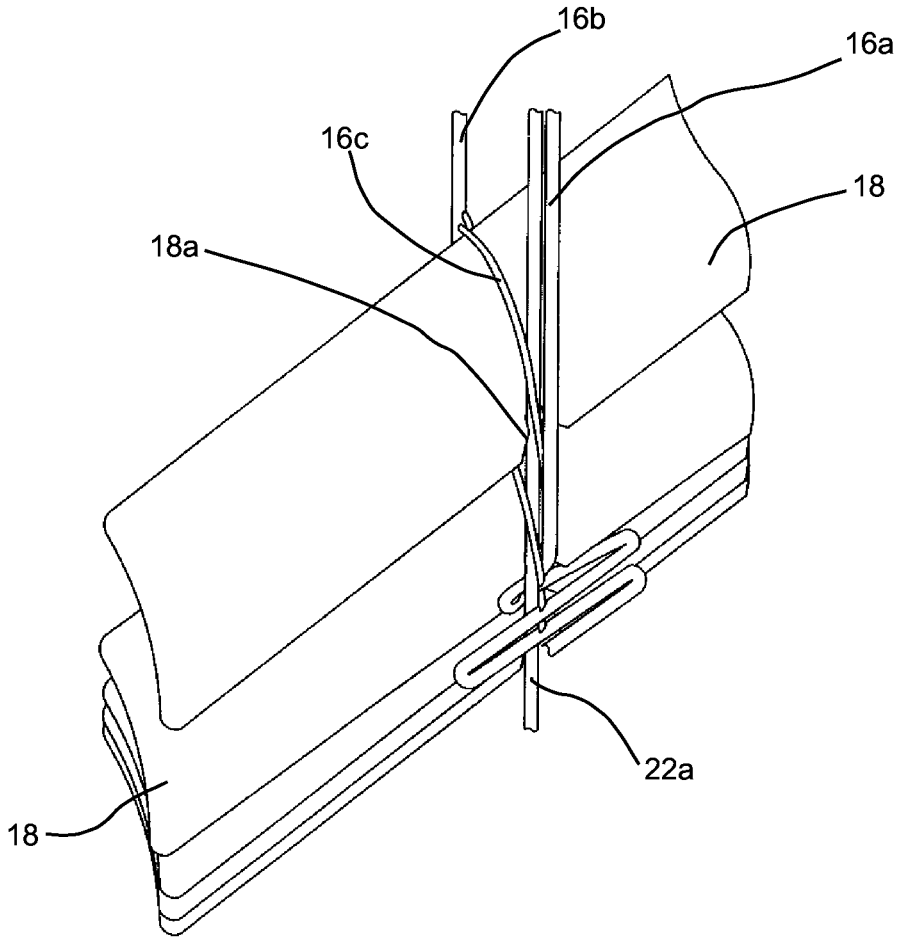
FIG. 18 is a partial perspective view showing interference between the cut-out portion and the ladder cord.

In contrast, if the slat is inclined and lifted so that the cut-out portions face downward when the slats are lifted, a loose portion of a vertical cord of a ladder cord might enter between the lifting/lowering cord and the cut-out portion as shown in FIG. 18, and moreover, the loose and folded portion might be caught by the corner of the cut-out portion. When the lowering operation is performed from that state, the slats are lowered while the cut-out portions face upward. Therefore, the catching is not released, and the slats are lowered while being drawn to each other. When the lowering operation is further continued, the slats may be lowered while they are not horizontally balanced.

However, in this embodiment, since the ladder cord is not caught at the time of lifting the slats, the above troubles can be eliminated.

Third Embodiment

Figure 17:
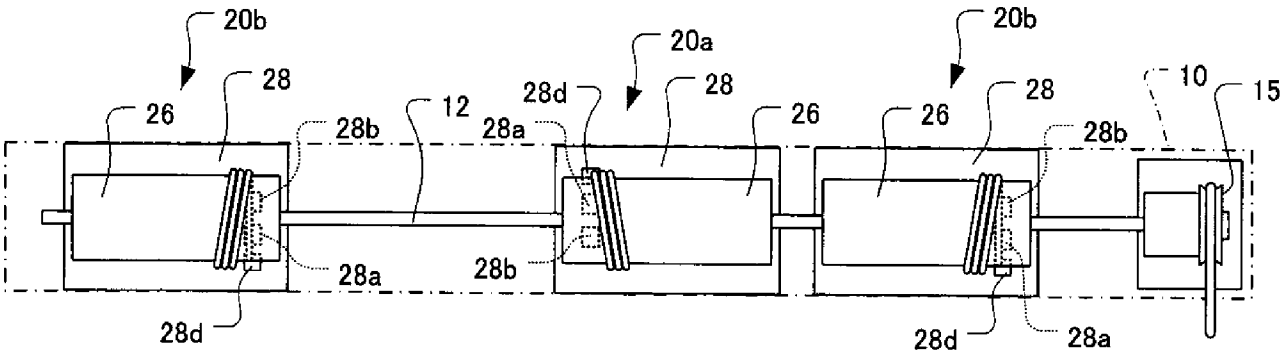
FIG. 17 is a plan view showing an inside of a head box according to a third embodiment.

Now, a third embodiment using a variation of a lifting/lowering drum is shown in FIG. 17.

In this example, a drum support 28 of a lifting/lowering drum 20 has only a lifting/lowering cord guide portion 28*d* provided outside ladder cord guide portions 28*a* and 28*b*. The right and left directions of the lifting/lowering drum 20 disposed inside at or near the center in the longitudinal direction are reversed from the left and right directions of the lifting/lowering drum 20 disposed outside in the longitudinal direction. According to this constitution, even when only one lifting/lowering cord guide portion 28*d* guiding the lifting/lowering cord 22 is provided, the position in the back and forth direction of the lifting/lowering cord guide portion 28*d* of the drum support 28 of the lifting/lowering drum 20 disposed inside at or near the center in the longitudinal direction is reversed from the position in the back and forth direction of the lifting/lowering cord guide portion 28*d* of the drum support 28 of the lifting/lowering drum 20 disposed outside in the longitudinal direction, and therefore, the lifting/lowering cords 22 can be disposed on the different sides of the slats between inside at or near the center in the longitudinal direction and outside in the longitudinal direction.

In the above embodiments, the lifting/lowering cord is disposed outside the side edge of the slat, so that a lifting/lowering cord insertion hole of the slat is omitted; however, this invention is not limited thereto and is similarly applicable to a case where a plurality of lifting/lowering cord insertion holes are provided at the position offset from the central portion in the back and forth direction of the slat and the lifting/lowering cords are arranged through the lifting/lowering cord insertion holes.

In the above embodiments, although the rotation shaft 12 is manually rotated and driven, this invention is not limited thereto, and the rotation shaft 12 is connected to an electric motor so that it can be electrically rotated and driven. By virtue of the use of the electric motor, the manual operation can be eliminated, and, at the same time, this invention is applicable to a blind attached to a hard to reach position such as high altitude, where motor operation is difficult.

The invention claimed is:

1. A venetian blind defining a transverse direction extending from a front side to a rear side of the venetian blind, comprising:

a rotation shaft rotatably supported in a head box, the head box defining a first head box side oriented toward one of the front and rear sides of the venetian blind and a second head box side oriented toward the other of the front and rear sides of the venetian blind;

a plurality of ladder cords capable of tilting in response to the rotation of the rotation shaft;

a plurality of slats supported in an aligned state by the ladder cords;

a plurality of lift cords configured to lift and lower the slats, each lift cord being disposed at a position offset in a transverse direction from a central portion, and a plurality of lift drums capable of rotating in response to rotation of the rotation shaft, an end of each lift cord windably and unwindably connected to a respective lift drum, at least one first lift cord extending into the head box adjacent the first head box side, continuing upward along the first head box side and having an end connected to a first respective lift drum, at least one second lift cord extending into the head box adjacent the second head box side, the second lift cord then extending transversely toward the first head box side, continuing upward adjacent the first head box side, and having an end connected to a second respective lift drum so that all the lift cords extending into the head box from the first and second head box sides are wound around the lift drums in a same winding orientation.

2. The venetian blind according to claim 1, wherein each of the lift drums comprises a drum portion to which one end of each of the lift cords is windably and unwindably connected and a drum support supporting the drum portion in a rotatable manner, and the drum support includes lift cord guide portions for supporting the lift cords from positions offset in the transverse direction from the central portion.

3. The venetian blind according to claim 2, wherein the drum support further includes ladder cord guide portions configured to maintain a distance between front and back vertical cords of each ladder cord less than a predetermined amount, and the lift cord guide portions are positioned outside of the ladder cord guide portions in the transverse direction.

4. The venetian blind according to claim 1, wherein the plurality of ladder cords includes at least a first ladder cord having a front vertical cord and a back vertical cord, each slat includes a side edge having at least one cut-out portion, a selected one of the front and back vertical cords of the first ladder cord is disposed along the at least one cut-out portion, and one of the first and second lift cords is disposed in the at least one cut-out portion and positioned between the at least one cut-out portion and the selected one of the front and back vertical cords.

5. The venetian blind according to claim 4, wherein an other of the first and second lift cords, which is not inserted in the cut-out portion, is disposed outside of the side edge of the slat.

6. The venetian blind according to claim 4, wherein the cut-out portion is formed only at the side edge of each slat.

7. The venetian blind according to claim 1, wherein the plurality of lift drums includes at least first, second, and third lift drums arranged in a longitudinal direction of the head box with the second lift drum being positioned between the first and third lift drums, the at least one first lift cord being operably coupled to the second lift drum, and the at least one second lift cord including two second lift cords operably coupled to the first and third lift drums, respectively.

8. The venetian blind according to claim 1, wherein the plurality of lift drums includes at least first, second, and third lift drums arranged in a longitudinal direction of the head box with the second lift drum being positioned between the first and third lift drums, the at least one first lift cord including two first lift cords operably coupled to the first and third lift drums, respectively, and the at least one second lift cord being operably coupled to the second lift drum.

* * * * *